US005124201A

United States Patent [19]

Kurabayashi et al.

[11] Patent Number: 5,124,201

[45] Date of Patent: Jun. 23, 1992

[54] RECORDING MEDIUM AND METHOD OF RECORDING USING THE SAME

[75] Inventors: Yutaka Kurabayashi, Yokohama; Mamoru Sakaki, Sagamihara; Hiroshi Sato, Yokohama, all of Japan

[73] Assignee: Canon Kabushiki Kaisha, Tokyo, Japan

[21] Appl. No.: 560,997

[22] Filed: Aug. 1, 1990

[51] Int. Cl.[5] ..... B41M 5/00

[52] U.S. Cl. ..... 428/323; 346/135.1; 428/195; 428/206; 428/211; 428/328; 428/329; 428/330; 428/331

[58] Field of Search ..... 348/1.1, 135.1, 141, 348/143, 148-150, 195, 206, 211, 323, 329-331, 409, 328

[56] References Cited

U.S. PATENT DOCUMENTS 4,758,461 7/1988 Akiya et al. ..... 428/195
4,965,612 10/1990 Sakaki et al. ..... 346/135.1

FOREIGN PATENT DOCUMENTS 0199874 11/1986 European Pat. Off. ..... 346/135.1
56-148585 11/1981 Japan ..... 346/135.1
60-49990 3/1985 Japan ..... 346/135.1
61-57380 3/1986 Japan ..... 346/135.1

*Primary Examiner*—Pamela R. Schwartz
*Attorney, Agent, or Firm*—Fitzpatrick, Cella, Harper & Scinto

[57] ABSTRACT

A recording medium having an ink-receiving layer containing a pigment and being formed on a support. The pigment is composed mainly of a pigment component having a specific surface area within the range of from 30 to 150 $m^2/g$ and an oil absorption value within the range of 2.0 to 5.0 cc/g; and the recording medium has a roughness index $K\gamma$ ($ml/m^2$) and an absorption coefficient $K\alpha$ ($m \cdot sec^{-\frac{1}{2}}$) according to the Bristow test, respectively within the ranges of $10 \leqq K\gamma \leqq 30$, and $5.0 \times 10^{-6} \leqq K\alpha \leqq 3.5 \times 10^{-5}$. A method of color ink jet recording by application of droplets of a recording liquid onto the recording medium.

34 Claims, 1 Drawing Sheet

(EXAMPLES OF BRISTOW TEST)

RECORDING MEDIUM AND METHOD OF RECORDING USING THE SAME

BACKGROUND OF THE INVENTION

1. Field of the Invention

The present invention relates to a recording medium that is suitable for ink jet recording, and particularly relates to a recording medium that is superior in absorption and color development of aqueous inks as well as in storage stability of recorded images. The present invention also relates to a recording method in which the recording medium is employed.

2. Related Background Art

Recording mediums for ink jet recording heretofore known include:

(1) those made by sizing of general paper mainly composed of pulp to a low degree into articles like filter paper or blotting paper, (2) those made by providing an ink absorbing layer with a porous inorganic pigment on a base paper, such as general wood-free paper, having low ink-absorbency as described in Japanese Patent Application Laid-open No. 56-148585, and the like.

In ink jet recording for forming color images of high quality and high resolution, particularly high image storability is required. To meet such requirements, methods are known that reduce fading of images caused by irradiation of visible light or ultraviolet light like sunshine (see, for example, Japanese Patent Applications Laid-open Nos. 60-49990, No. 61-57380, etc.).

Recently, however, indoor discoloration of recorded images has become an important problem peculiar to coated paper.

This is different from the usual problems of light resistance which relate, for example, to fading of images by irradiation of ultraviolet light or visible light that occurs in images formed on any kind of paper including general PPC paper, wood-free paper, coated ink-jet-recording paper, and the like. On the contrary, the indoor discoloration of images discussed in the present invention occurs on coated paper stored, for example, in absence of direct sunlight irradiation, but does not occur in images printed on non-coated paper like PPC paper, which is different from the above mentioned problems on light resistance.

As mentioned above, the indoor discoloration is peculiar to coated paper. Accordingly, the indoor discoloration is considered to be caused by a pigment in the coat layer. The indoor discoloration is known to be dependent on the specific surface area of the pigment employed. Although the discoloration is retarded by use of an ordinary paper-filler, such as calcium carbonate, kaolin, talc, and the like having a smaller specific surface area, the use of such a filler involves the problems that the resulting image density is low, and high quality and high resolution of the image cannot be achieved. On the contrary, the coated paper comprising silica having a larger surface area and a higher activity as disclosed in Japanese Patent Application Laid-open No. 56-185690 involves the disadvantage of significant indoor discoloration although it gives images of high optical density.

As discussed above, the suppression of the indoor discoloration is inconsistent with an increase of image density, which could not be solved by the prior art.

SUMMARY OF THE INVENTION

An object of the present invention is to provide a recording medium having high storage stability of the recorded images, giving a high image density with less indoor deterioration of the images, and being particularly suitable for ink jet recording.

Another object of the present invention is to provide a recording method that employs the aforementioned recording medium.

According to an aspect of the present invention, there is provided a recording medium having an ink-receiving layer containing a pigment and being formed on a support: said pigment being composed mainly of a pigment component having a specific surface area within the range of from 30 to 150 $m^2/g$ and an oil absorption value within the range of 2.0 to 5.0 cc/g; and said recording medium having a roughness index $K\gamma$ ($ml/m^2$) and an absorption coefficient $K\alpha$ ($m \cdot sec^{-\frac{1}{2}}$) according to the Bristow test, respectively within the ranges of $10 \leqq K\gamma \leqq 30$, and $5.0 \times 10^{-6} \leqq K\alpha \leqq 3.5 \times 10^{-5}$.

According to another aspect of the present invention, there is provided a method of recording by application of droplets of a recording liquid onto a recording medium having an ink receiving-layer containing a pigment and being formed on a support; said pigment being composed mainly of a pigment component having a specific surface area within the range of from 30 to 150 $m^2/g$ and an oil absorption value within the range of 2.0 to 5.0 cc/g, and said recording medium having a roughness index $K\gamma$ ($ml/m^2$) and an absorption coefficient $K\alpha$ ($m \cdot sec^{-\frac{1}{2}}$) according to the Bristow test, respectively within the ranges of $10 \leqq K\gamma \leqq 30$, and $5.0 \times 10^{-6} \leqq K\alpha \leqq 3.5 \times 10^{-5}$.

According to still another aspect of the present invention, there is provided a method of ink jet recording by application of droplets of a recording liquid onto a recording medium having an ink-receiving layer containing a pigment and being formed on a support: said pigment being mainly composed of a pigment component having a specific surface area within the range of from 30 to 150 $m^2/g$ and an oil absorption value within the range of 2.0 to 5.0 cc/g; and said recording medium having a roughness index $K\gamma$ ($ml/m^2$) and an absorption coefficient $K\alpha$ ($m \cdot sec^{-\frac{1}{2}}$) according to the Bristow test, respectively within the ranges of $10 \leqq K\gamma \leqq 30$, and $5.0 \times 10^{-6} \leqq K\alpha 3.5 \times 10^{-5}$.

According to a further aspect of the present invention, there is provided a method of color ink jet recording by application of droplets of color recording liquids in a plurality of colors onto a recording medium having an ink-receiving layer containing a pigment and being formed on a support: said pigment being mainly composed of a pigment component having a specific surface area within the range of from 30 to 150 $m^2/g$ and an oil absorption value within the range of 2.0 to 5.0 cc/g, and said recording medium having a roughness index $K\gamma$ ($ml/m^2$) and an absorption coefficient $K\alpha$ ($m \cdot sec^{-\frac{1}{2}}$) according to the Bristow test, respectively within the ranges of $10 \leqq K\gamma \leqq 30$, and $5.0 \times 10^{-6} \leqq K\alpha \leqq 3.5 \times 10^{-5}$.

DETAILED DESCRIPTION OF THE PREFERRED EMBODIMENT

Figure 1:
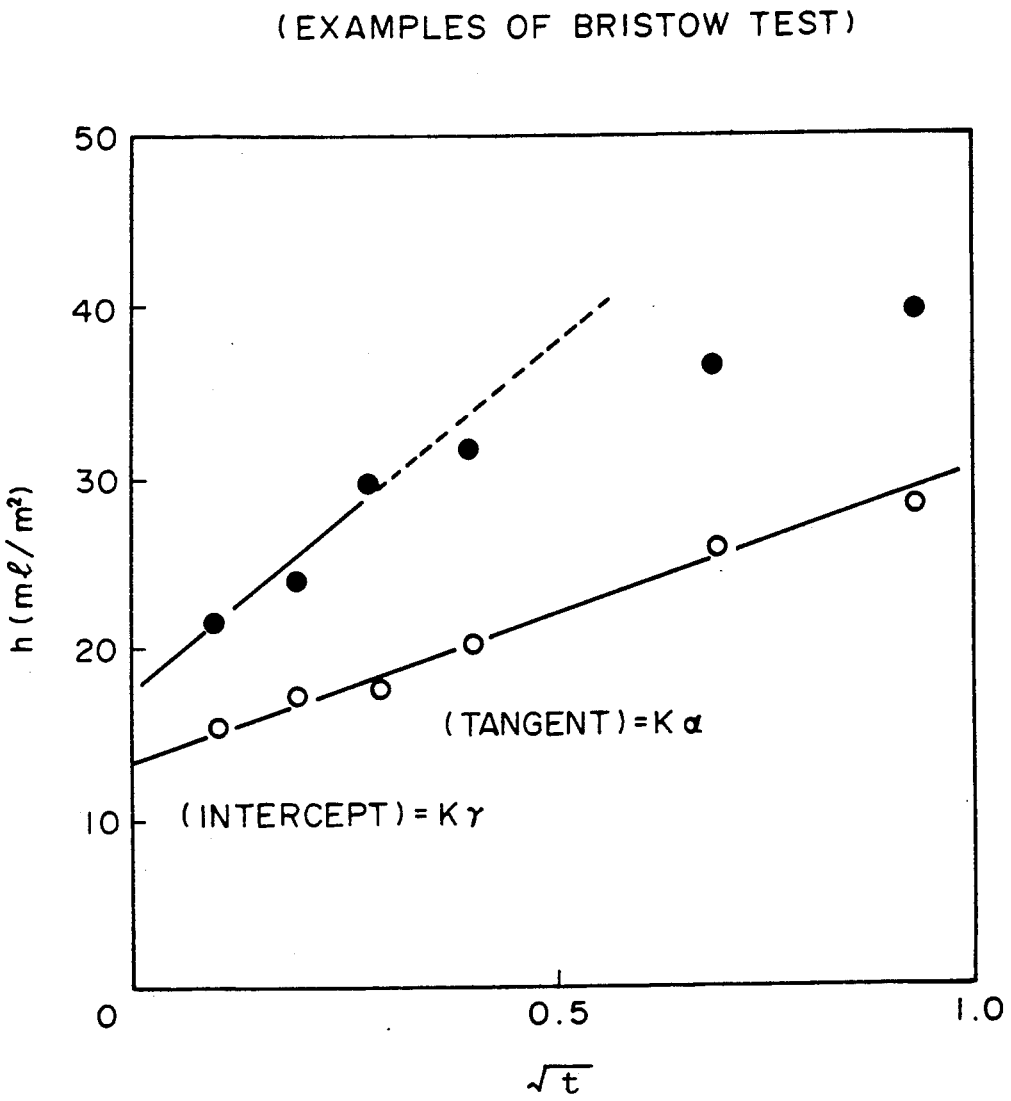
FIG. 1 illustrates a method for deriving $K\alpha$ (an absorption coefficient) and $K\gamma$ (a roughness index).

The inventors of the present invention consider that the indoor discoloration of recorded images is caused by oxidative decomposition of dyes, and assume that, on coated paper in which an image is formed by fixation of a dye in a surface layer of the recording medium, the larger the specific surface area of the pigment employed in a coated layer or an ink receiving layer in the present invention, the higher is the probability of occurrence of catalytic air oxidation, and accordingly the more the indoor discoloration proceeds.

However, the use of a conventional pigment having a small specific surface area will result in insufficiency of dye adsorption ability, fixing a decreased amount of dyes around a surface layer of an ink receiving layer without formation of a high density image, so that the image of high density can not be obtained.

In the present invention, the ink retention volume in an ink receiving layer is made larger, and the permeation of ink to the support side is suppressed by use of a pigment exhibiting larger oil absorption value, and a dye is made to be fixed around the ink receiving layer by adjustment of a roughness index $K\gamma$ ($ml/m^2$) and an absorption coefficient $K\alpha$ ($m \cdot sec^{-\frac{1}{2}}$) according to the Bristow test, respectively within the ranges of $10 \leqq K\gamma \leqq 30$, and $5.0 \times 10^{-6} \leqq K\alpha \leqq 3.5 \times 10^{-5}$.

At the surface area of the pigment of less than 30 $m^2/g$, the dye absorption ability is insufficient for giving satisfactory density of images around the surface of the ink receiving layer. On the other hand, at the surface area of the pigment exceeding 150 $m^2/g$, the indoor discoloration becomes remarkable.

At the oil absorption value of the pigment of less than 2.0 cc/g, the ink retension volume decreases, causing a problem of running-over of ink or decreased fixation of ink. On the other hand, at the oil absorption value exceeding 5.0 cc/g, the pigment captures a binder used for forming the ink-receiving layer, causing falling-off in powder of the ink-receiving layer or the like phenomenon.

The oil absorption value in the present invention means the maximum amount of boiled oil added to a unit weight of a pigment with agitation before the pigment loses its powder properties.

At the roughness index $K\alpha$ of a recording medium of less than 10, ink is not retained substantially in an ink-receiving layer, causing running-off of ink or insufficient fixation of ink. At the index of exceeding 30, ink rapidly migrates to the support side, not giving a sufficient image density.

At the absorption coefficient of the recording medium of less than $5.0 \times 10^{-6}$ $m \cdot sec^{-\frac{1}{2}}$, the penetration speed is low, fixation ability being lowered. At the coefficient exceeding $3.5 \times 10^{-5}$, the penetration to the support side proceeds more rapidly, giving insufficient image density.

An embodiment of the present invention is described to explain the invention in more detail.

The materials constituting the ink-receiving layer in the present invention include a pigment, a binder, and other additives necessary for securing sufficient fastness of images.

The average particle diameter of the pigment is preferably not more than 20 μm, more preferably not more than 10 μm. Excessively large particle diameters of the pigment will cause falling-off in powder. Narrower distribution of the particle diameter is preferable since it will give more easily a true round shape of recorded dots with higher resolution, giving a sharper recorded image. For this reason, the fraction in number of pigment particles having the diameters of 10 μm or more is desirably not more than 1% of the total pigment particles in number in order to improve the resolution.

The pigment described above is not necessarily limited to one compound, but may be used mixedly with other known pigments, if necessary. Pigments which may be used mixedly include calcium carbonate, silica, alumina, aluminum silicate, calcium silicate, clay, kaolin, talc, diatomaceous earth, magnesium silicate, magnesium oxalate, magnesium-calcium carbonate, and the like, but is not limited thereto.

Such a pigment may be mixed in an arbitrary mixing ratio if the specific surface area and the oil absorption value satisfies the pigment properties defined in this Specification. Preferably, the pigment having specific a surface area of from 30 to 150 $m^2/g$ and the oil absorption value of from 2.0 to 5.0 cc/g accounts for 60% by weight or more of the entire pigments.

The binders which may be used in the present invention include known water-soluble polymers such as polyvinyl alcohol, starch, oxidized starch, cationized starch, casein, carboxymethylcellulose, gelatin, hydroxyethylcellulose, acrylic resins, and the like; water dispersion type polymer such as SBR latexes, polyvinyl acetate emulsions, and the like: and their mixtures.

The ratio of the pigment to the binder in the present invention is preferably within the range of from 10/1 to $\frac{1}{4}$ by weight (as pigment/binder [P/B]), more preferably from 6/1 to 1/1. At the binder content of higher than the P/B ratio of $\frac{1}{4}$, the ink absorbing ability of the ink-receiving layer becomes lowered unpreferably. At the pigment content higher than the P/B ratio of 10/1, the falling-off in powder of the ink-receiving layer becomes significantly unpreferable.

Further in the present invention, the ink-receiving layer may contain, if necessary, an additive such as a dye-fixing agent (a water-resistance-giving agent), a fluorescent whitening agent, surface active agent, an anti-foaming agent, a pH controlling agent, a mildew-proofing agent, a UV-absorbing agent, an antioxidation agent, a dispersing agent, a viscosity-reducing agent, and the like.

The support in the present invention is preferably a base paper having an ink-absorbing property, but is not limited thereto, and a known polymer film, or the like may be used.

A preferable method for preparing a recording medium of the present invention is described below for a case where a base paper having an ink-absorbing property is used.

In the preparation of the recording medium of the present invention, an aqueous coating liquid containing a pigment, a binder, and an additive as described above is applied onto a surface of a base material according to a known method such as roll coating, blade coating, air knife coating, gate roll coating, size pressing, and the like. Thereafter, the coated material is dried, for example, with a hot-air drier, a hot drum, or the like to obtain the recording medium of the present invention.

Further, the ink-receiving layer may be subjected to supercalender treatment in order to smoothen its surface or to increase its surface strength.

The amount of coating of the pigment of the ink-receiving layer is preferably in the range of from 0.2 to 20 g/m$^2$, more preferably from 0.2 to 8 g/m$^2$ as the total amount pigments. At an amount of the coating of less than 0.2 g/m$^2$, no effect of the ink-receiving layer on the color developability, namely a pigment-containing layer, is found in comparison with the case of no ink-receiving layer employed. At the amount of the coating of more than 20 g/m$^2$, or at the maximum thickness of the ink-receiving layer of 25 $\mu$m or more, paper powder may be generated undesirably.

The term "maximum thickness of the ink-receiving layer" in the present invention means the maximum value of thickness of the ink-receiving layer in the depth direction at the cross-section of the recording medium. The "amount of coating of pigment" is derived by subtracting the ash content of the base paper or the support from the total ash content of the recording medium according to JIS-P 8128.

The recording medium of the present invention may have an ink-receiving layer of a single layer structure as described above, or otherwise of a multi-layer structure in which a water absorbent pigment layer is provided under the above-mentioned ink-receiving layer.

In forming an image on a recording medium of the present invention thus prepared by using various aqueous color inks such as yellow (Y), magenta (M), cyan (C), black (Bk), etc. by ink jet recording method, it has been found that the recording medium having the roughness index K$\gamma$ (ml/m$^2$) and the absorption coefficient K$\alpha$ (m·sec$^{-\frac{1}{2}}$) in the ranges shown below will give particularly a high image density and be free from disadvantages of running-over of ink or lowering of ink fixing ability, etc.: $10 \leqq K\gamma \leqq 30$, and $5.0 \times 10^{-6} \leqq K\alpha \leqq 3.5 \times 10^{-5}$.

The roughness index and the absorption coefficient measured by the Bristow test in the present invention are explained below in detail.

The Bristow test employed in the present invention is a test for ink migration tendency, which was conducted by Bristow and Lyne (see J. A. Bristow: Svensk Papperstiding 19 15 (1967); M. B. Lyne, J. S. Aspler: Tappi 65 98 (1982)).

The surface roughness index means the quantity of migration (permeation depth) of liquid at a contact time t=0 or in wetting time between paper and the ink head, which is derived experimentally by extrapolating the plots of the permeation depth (h) (unit: ml/m$^2$) vs. $\frac{1}{2}$ power of the contact time ($\sqrt{t}$ (sec$^{-\frac{1}{2}}$)) to t=0. The absorption coefficient means the tangent of the aforementioned plots (unit: m·sec$^{-\frac{1}{2}}$). If the plots are not on a line over a broad range, the tangent is taken at short contact times of up to t=0.3. FIG. 1 illustrates some typical results of the Bristow test.

The surface roughness index and the absorption coefficient vary depending on the kind of a pigment of the ink receiving layer, oil absorption value, and particle diameter of pigments, the kind of the binders, the ratio of the pigment to the binder, the thickness of the ink-receiving layer, and surface roughness and sizing degree of the base paper. The approximate sizing degree of a base paper for the recording medium of the present invention is preferably 15 to 40 seconds in terms of Stöckigt sizing degree converted to basis weight of 65 g/m$^2$.

If the particle diameter of the pigment is smaller, the ink absorption capacity is smaller, giving a smaller K$\gamma$ value, and ink permeation speed is lower, giving a smaller K$\alpha$ value. For the same reason, if the ratio of the binder to the pigment is larger, both K$\gamma$ and K$\alpha$ is lower. If the surface roughness of the base paper is larger, the K$\gamma$ value is larger. More specifically, the recording medium of the present invention can be prepared based on the method described below.

Since the surface roughness index, K$\alpha$, is susceptible to the surface roughness of the base paper in the thickness range of the ink-receiving layer of from 0.2 to 20 g/m$^2$, the base paper which has the surface roughness index within the range of from 10 to 30 ml/m$^2$ is selected by the Bristow test of base paper singly.

Regarding the K$\gamma$ value, $K\gamma^B$ and $K\alpha^B$ are measured of the base paper singly, and further, $K\gamma^C$ and $K\alpha^C$ are measured of an ink-receiving layer provided in an amount ranging from 20 to 50 g/m$^2$ on a support having no ink absorbing property.

If $K\alpha^B - K\alpha^C \geqq 10$, then the K$\gamma$ of the recording medium having an ink-receiving layer becomes larger, being liable to become larger than $3.5 \times 10^{-5}$ m·sec$^{-1}$. In such cases, $K\gamma^B$ and $K\gamma^C$ is frequently and preferably set within the range of from $2 \times 10^{-6}$ to $1 \times 10^{-5}$ m·sec$^{-\frac{1}{2}}$.

On the other hand, if $K\alpha^B - K\alpha^C \frac{3}{4}$ 10, then $K\alpha^C$ set within the range of $5.0 \times 10^{-6} \leqq K\alpha \leqq 3.5 \times 10^{-5}$ tends to give K$\gamma$ within the specified range irrespectively of $K\gamma^B$. However, the above values are only for an approximate standard, and are not limited thereto. Even outside the above value ranges, the values in the defined range of the present invention can be achieved. Incidentally, the setting of K$\gamma$, and K$\alpha$ is not necessarily based on the above-mentioned method.

Accordingly, in the present invention, a recording medium which gives sufficient image density and satisfactory fixation ability can be obtained by bringing the values of K$\gamma$ and K$\alpha$ within the defined ranges even when the above-indicated properties of the ink-receiving layer and the support may vary. Moreover, the image formed on the recording medium thus prepared causes indoor discoloration with extreme difficulty.

The ink itself for the recording on the recording medium of the present invention may be a known ink. The specific examples of the recording agent are water-soluble dyes such as direct dyes, acid dyes, basic dyes, reactive dyes and the like.

Such a water-soluble dye is generally used at a rate of approximately from 1 to 20% by weight in conventional inks. This rate may also be employed in the present invention.

The solvent used for the aqueous ink of the present invention is water or a mixture of water and a water-soluble organic solvent: particularly suitable is a mixture of water and a water-soluble organic solvent containing a polyhydric alcohol which exhibits an ink-drying prevention effect. The water to be used is preferably deionized water, not being usual water containing various ions.

The content of the water-soluble organic solvent in the ink is generally in the range of from 0 to 95% by weight, preferably from 2 to 80% by weight, more preferably from 2 to 50% by weight based on the total weight of the ink.

The ink used for the recording may contain a surfactant, a viscosity-adjusting agent, a surface-tension-adjusting agent, and the like, if necessary, in addition to the above-described components.

The method for applying the ink onto the recording medium is not limited, and any method may be employed. Among the methods, an ink jet recording method is preferable in which an ink is ejected from a nozzle effectively to apply ink onto the shot object of a recording medium.

In particular, the ink jet method described in Japanese Patent Laid-open Publication No. 54-59936 can be effectively employed, in which ink is caused to abruptly change its volume by action of thermal energy, and the force generated by this change of the state serves to ejects the ink through a nozzle.

The present invention is described in more detail referring examples and comparative examples. In the description, parts or % is based on weight unless otherwise mentioned.

EXAMPLE 1

A base material is provided which has a Stöchigst sizing degree of 40 seconds, a basis weight of 65 g/m$^2$, and a calcium carbonate content of 9.0% according to the ash content conversion of JIS-P 8128. (In the examples and comparative examples, the base paper has a basis weight of 65 g/m$^2$.)

A coating liquid was prepared according to the procedures below.

To 100 parts of water was added 10 parts of calcium silicate made by Tokuyama Soda Co., Ltd. (specific surface area: 110 m$^2$/g, oil absorption value: 4.5 cc/g, average particle diameter: 20 $\mu$m, the particle size distribution being measured by a Coulter counter method, which method is employed in Examples and Comparative examples below). Thereto sodium hexametaphosphate was added as a dispersant in an amount of 2% by weight based on the pigment. The mixture was agitated with a power homogenizer at 5,000 rpm for 10 minutes to prepare a pigment slurry.

A 10% aqueous solution of polyvinyl alcohol made by Kuraray Co., Ltd. (PVA-117, saponification degree: 98.5%$_{mol}$, PVA content: 94%, viscosity: 5.6 cps at 4% at 20° C.) was mixed therewith in a ratio of PVA to pigment of 1:1 to prepare a coating liquid.

The coating liquid thus prepared was applied by a bar coater and dried so as to give a dry weight of 8 g/m$^2$ to provide Recording medium (1) of the present invention. The values of K$\gamma$ and K$\alpha$ of the recording medium according to the Bristow test were respectively as below.

K$\gamma$=18 ml/m$^2$

K$\alpha$=7.5×10$^{-6}$ m·sec$^{-\frac{1}{2}}$

The suitability of the above recording medium to ink jet recording was evaluated by conducting ink jet recording with an ink jet printer provided with four ink jet heads for four colors of Y, M, C and Bk, each being constituted of 128 nozzles at an interval of 16 nozzles per mm which ejects ink droplets by action of thermal energy using the ink having the composition below.

Ink Composition

Dye: 5 parts
Diethylene glycol: 20 parts
Water: 75 parts

Dyes

Y: C.I. Direct Yellow 86
M: C.I. Acid Red 35
C: C.I. Direct Blue 199
Bk: C.I. Food Black 2

The evaluation was made regarding the items below:

(1) Image Density

The image density of the solid print (Bk) which was printed by using the aforementioned ink jet printer was evaluated with a MacBeth Reflecto-densitometer.

(2) Ink Fixation Ability

The fixation ability was visually evaluated at the two-color solid print portions of Y and M, M and C, and Y and C, respectively.

(3) Indoor Storability

The printed matter obtained for Item (1) of the test was left stuck onto a wall of an office room for 6 months. The indoor storability was evaluated from the difference $\Delta$E (Bk) between the chromaticity immediately after the printing and that after having been left stuck onto the wall.

(The evaluation was made in the same manner in other Examples and Comparative examples.)

The results of the evaluation are shown in Table 1 together with the results from the other recording mediums. As shown in Table 1, the Recording medium (1) is an ink jet recording medium which is excellent in ink fixation ability and high in image density, and causes less indoor discoloration.

EXAMPLE 2

The pigment used in Example 1 was pulverized to have an average particle diameter of 3.8 $\mu$m, from which the particles having diameters of 7 $\mu$m or more were cut away by classification. The pulverized pigment had an oil absorption value of 3.8 cc/g, and specific surface area of 110 m$^2$/g.

A coating liquid was prepared with this pulverized pigment and was applied and dried according to the same formulation and the same procedure as in Example 1 on base paper having a Stöckigst sizing degree of 30 seconds so as to give a dry weight of 8 g/m$^2$ to obtain Recording medium (2) of the present invention. The resulting recording medium (2) had a K$\gamma$ value of 20 ml/m$^2$, and a K$\alpha$ value of 6.5×10$^{-6}$ m·sec$^{-\frac{1}{2}}$.

The evaluation results were nearly the same as those of Example 1 as shown later in Table 1. However, the ink dots as observed with an optical microscope had true round shape with less feathering, and the resolution of images were improved.

EXAMPLE 3

Recording medium (3) of the present invention was prepared in the same manner as in Example 2, except that basic magnesium carbonate (made by Kohnoshima Kagaku K.K., trade name: Kinsei), having the properties below, was added to the pigment used in Example 2 in an amount of 40% of the pigment.

Average particle diameter: 6 $\mu$m
Specific surface area: 30 m$^2$/g

The mixed pigment used for the Recording medium (3) had a specific surface area of 70 m$^2$/g, and an oil absorption value of 2.4 cc/g. The Stöckigt sizing degree of the base paper was 15 seconds, and the amount of the coating was 5 g/m$^2$. The Recording medium (3) had values of K$\gamma$ and K$\alpha$ as below:

K$\gamma$=15 ml/m$^2$

K$\alpha$=2.0×10$^{-5}$ m·sec$^{-\frac{1}{2}}$

The evaluation results show that the image density and fixation ability were at nearly the same level as those of Examples 1 and 2, and the resistance to indoor discoloration was further improved.

TABLE 1

Image Densities (O.D. of Bk), Ink Fixation Ability, and Indoor Discoloration (ΔE of Bk) in Examples 1-3

| Example | OD (Bk) | Ink fixation ability | ΔE (Bk) |
|---|---|---|---|
| 1 | 1.40 | excellent | 3.0 |
| 2 | 1.45 | good | 2.4 |
| 3 | 1.40 | excellent | 0.3 |

EXAMPLE 4 to 6

Six-color solid print patterns of cyan, magenta, yellow, red (magenta yellow), green (cyan yellow), and blue (cyan magenta) were formed on the same recording media (1) to (3) as used in Example 1 to 3 by using the aforementioned ink jet printer.

Storability tests of the patterns were carried out in the same manner as in the Examples, followed by measuring $\Delta E^*_{ab}$. The results are shown in the following Table 2.

TABLE 2

| Example No. | cyan | magenta | yellow | red | green | blue |
|---|---|---|---|---|---|---|
| 4 | 8.5 | 6.8 | 2.0 | 6.5 | 8.0 | 9.0 |
| 5 | 6.8 | 5.0 | 2.0 | 5.0 | 6.5 | 7.0 |
| 6 | 5.4 | 4.2 | 1.5 | 4.0 | 5.0 | 6.0 |

COMPARATIVE EXAMPLES 1-5

As Comparative examples 1 to 3, on base paper having a Stöckigt sizing degree of 0 second, the same ink-receiving layer as in Examples 1, 2, or 3 was formed, respectively. The values of $K\gamma$, and $K\alpha$ of the resulting recording mediums were varied as shown later in Table 3. The densities of the images formed on these recording mediums in the same manner as in the above Examples were lower than those of Examples 1, 2, and 3. (The method of evaluation was the same as in Examples 1 to 3. See Table 4.)

A recording medium of Comparative example 4 was prepared in the same manner as in Example 3 except that base paper having a Stöckigst sizing degree of 40 seconds was used in place of the support of Example 3. The values of $K\gamma$ and $K\alpha$ of the resulting recording medium was as shown in Table 3. As the result of image formation in the same manner as in Examples, the ink fixation ability was found to be extremely lowered. (See Table 4).

TABLE 3

| Comparative example | $K\gamma$ (ml/m$^2$) | $K\alpha$ (m · msec$^{-\frac{1}{2}}$) |
|---|---|---|
| 1 | 25 | $5.0 \times 10^{-5}$ |
| 2 | 20 | $4.3 \times 10^{-5}$ |
| 3 | 43 | $3.4 \times 10^{-5}$ |
| 4 | 8 | $2.0 \times 10^{-6}$ |

A recording medium of Comparative example 5 was prepared in the same formulation and the same procedure as in Example 1 with a coating amount of 8 g/m$^2$ except that basic magnesium carbonate AM-50 (made by Asahi Glass Co., Ltd., average particle diameter 9 μm) having a specific surface area of 35 m$^2$/g and an oil absorption value of 130 g/cc was used in place of the pigment in Example 1 and base paper having Stöckigst sizing degree of 30 seconds. The recording medium had values of $K\gamma$ of 12 ml/m$^3$ and $K\alpha$ of $5.3 \times 10^{-6}$ m·sec$^{-\frac{1}{2}}$. As shown in Table 4, the ink fixing property was found to be inferior and to be unsuitable for an ink jet recording medium.

TABLE 4

Image Densities (O.D. of Bk), Ink Fixation Ability, and Indoor Discoloration (ΔE of Bk) in Comparative Examples 1 to 5

| Comparative example | OD (Bk) | Ink fixation ability | ΔE (Bk) |
|---|---|---|---|
| 1 | 1.20 | excellent | 2.5 |
| 2 | 1.24 | excellent | 2.7 |
| 3 | 1.10 | excellent | 0.2 |
| 4 | * | poor | — |
| 5 | * | poor | — |

*Unable to be evaluated because of runningover of ink (Remark) The value of ΔE is approximately 10 or more when discoloration is perceived visually.

As described above, the present invention provides a recording medium which is superior in ink fixation ability, capable of giving high density of image without indoor discoloration, and suitable for ink jet recording.

What is claimed is:

1. A recording medium having an ink-receiving layer including a coating of pigment in an amount of at least 0.2 g/m$^2$ and being formed on a support; said pigment being mainly composed of a pigment component having a specific surface area within the range of from 30 to 150 m$^2$/g and an oil absorption value within the range of 2.0 to 5.0 cc/g; and said recording medium having a roughness index $K\gamma$ (ml/m$^2$) and an absorption coefficient $K\alpha$ (m·sec$^{-\frac{1}{2}}$) according to Bristow test, respectively within the ranges of $10 \leqq K\gamma \leqq 30$, and $5.0 \times 10^{-6} \leqq K\alpha \leqq 3.5 \times 10^{5}$.

2. The recording medium of claim 1, wherein the pigment component is contained at a content of 60% or more in the pigment.

3. The recording medium of claim 1, wherein primary particles of the pigment component have particle diameters within the range of from 0.01 to 20 μm.

4. The recording medium of claim 1, wherein the fraction of particles of the pigment component having a particle diameter of not less than 10 μm is not more than 1% of the total particles of the pigment component.

5. The recording medium of claim 1, wherein the support is base paper having ink absorbency.

6. The recording medium of claim 1, wherein the pigment component is at least one pigment selected from the group consisting of calcium carbonate, silica, alumina, aluminum silicate, calcium silicate, clay, kaolin, talc, diatomaceous earth, magnesium silicate, magnesium oxalate, and magnesium-calcium carbonate.

7. The recording medium of claim 1, wherein said coating of pigment is in an amount ranging from 0.2 to 20 g/m$^2$.

8. A method of recording comprising the step of:

applying droplets of a recording liquid onto a recording medium having an ink receiving layer including a coating of pigment in an amount of at least 0.2 g/m$^2$ and being formed on a support; said pigment being mainly composed of a pigment component having a specific surface area within the range of from 30 to 150 m$^2$/g and an oil absorption value within the range of 2.0 to 5.0 cc/g; and said recording medium having a roughness index $K\gamma$ (ml/m$^2$) and an absorption coefficient $K\alpha$ (m·sec$^{-\frac{1}{2}}$) according to Bristow test, respectively within the ranges of $10 \leqq K\gamma \leqq 30$, and $5.0 \times 10^{-6} \leqq K\alpha \leqq 3.5 \times 10^{-5}$.

9. The method of recording of claim 8, wherein, the recording liquid contains a water soluble dye.

10. The method of recording of claim 9, wherein, the water-soluble dye is a direct dye or an acid dye.

11. The method of recording of claim 8, wherein the pigment component is contained at a content of 60% or more in the pigment.

12. The method of recording of claim 8, wherein primary particles of the pigment component have particle diameters within the range of from 0.01 to 20 μm.

13. The method of recording to claim 8, wherein the fraction of particles of the pigment component having a particle diameter of not less than 10 μm is not more than 1% of the total particles of the pigment component.

14. The method of recording of claim 8, wherein the support is base paper having ink absorbing property.

15. The method of recording of claim 8, wherein the pigment component is at least one pigment selected from the group consisting of calcium carbonate, silica, alumina, aluminum silicate, calcium silicate, clay, kaolin, talc, diatomaceous earth, magnesium silicate, magnesium oxalate, and magnesium-calcium carbonate.

16. The method of recording of claim 8, wherein said coating of pigment is in an amount ranging from 0.2 to 20 $g/m^2$.

17. A method of ink jet recording comprising the step of:

applying droplets of a recording liquid onto a recording medium having an ink-receiving layer including a coating of pigment in an amount of at least 0.2 $g/m^2$ and being formed on a support; said pigment being mainly composed of a pigment component having a specific surface area within the range of from 30 to 150 $m^2/g$ and an oil absorption value within the range of 2.0 to 5.0 cc/g; and said recording medium having a roughness index $K\gamma$ ($ml/m^2$) and an absorption coefficient $K\alpha$ ($m \cdot sec^{-\frac{1}{2}}$) according to Bristow test, respectively within the ranges of $10 \leqq K\gamma \leqq 30$, and $5.0 \times 10^{-6} \leqq K\alpha \leqq 3.5 \times 10^{-5}$.

18. The method of ink jet recording of claim 17, wherein, the recording liquid contains a water soluble dye.

19. The method of ink jet recording of claim 18, wherein, the water-soluble dye is a direct dye or an acid dye.

20. The method of ink jet recording of claim 17, wherein the pigment component is contained at a content of 60% or more in the pigment.

21. The method of ink jet recording of claim 17, wherein primary particles of the pigment component have particle diameters within the range of from 0.01 to 20 μm.

22. The method of ink jet recording of claim 17, wherein the fraction in number of particles of the pigment component having a particle diameter of not less than 10 μm is not more than 1% of the total particles of the pigment component.

23. The method of ink jet recording of claim 17, wherein the support is base paper having ink absorbing property.

24. The method of ink jet recording of claim 17, wherein the pigment component is at least one pigment selected from the group consisting of calcium carbonate, silica, alumina, aluminum silicate, calcium silicate, clay, kaolin, talc, diatomaceous earth, magnesium silicate, magnesium oxalate, and magnesium-calcium carbonate.

25. The method of ink jet recording of claim 17, wherein said coating of pigment is in an amount ranging from 0.2 to 20 $g/m^2$.

26. A method of color ink jet recording comprising the step of:

applying droplets of color recording liquids in a plurality of colors onto a recording medium having an ink-receiving layer including a coating of pigment in an amount of at least 0.2 $g/m^2$ and being formed on a support; said pigment being mainly composed of a pigment component having a specific surface area within the range of from 30 to 150 $m^2/g$ and an oil absorption value within the range of 2.0 to 5.0 cc/g; and said recording medium having a roughness index $K\gamma$ ($ml/m^2$) and an absorption coefficient $K\alpha$ ($m \cdot sec^{-\frac{1}{2}}$) according to Bristow test, respectively within the ranges of $10 \leqq K\gamma \leqq 30$, and $5.0 \times 10^{-6} \leqq K\alpha \leqq 3.5 \times 10^{-5}$.

27. The method of color ink jet recording of claim 26, wherein, the recording liquid contains a water soluble dye.

28. The method of color ink jet recording of claim 27, wherein, the water-soluble dye is a direct dye or an acid dye.

29. The method of color ink jet recording of claim 26, wherein the pigment component is contained at a content of 60% or more in the pigment.

30. The method of color ink jet recording of claim 26, wherein primary particles of the pigment component have particle diameters within the range of from 0.01 to 20 μm.

31. The method of color ink jet recording of claim 26, wherein the fraction in number of particles of the pigment component having a particle diameter of not less than 10 μm is not more than 1% of the total particles of the pigment component.

32. The method of color ink jet recording of claim 26, wherein the support is base paper having ink absorbing property.

33. The method of color ink jet recording of claim 26, wherein the pigment component is at least one pigment selected from the group consisting of calcium carbonate, silica, alumina, aluminum silicate, calcium silicate, clay, kaolin, talc, diatomaceous earth, magnesium silicate, magnesium oxalate, and magnesium-calcium carbonate.

34. The method of color ink jet recording of claim 26, wherein said coating of pigment is in an amount ranging from 0.2 to 20 $g/m^2$.

* * * * *

UNITED STATES PATENT AND TRADEMARK OFFICE

CERTIFICATE OF CORRECTION

PATENT NO. : 5,124,201

DATED : June 23, 1992

INVENTOR(S) : Kurabayashi et al.

It is certified that error appears in the above-identified patent and that said Letters Patent is hereby corrected as shown below:

ON THE TITLE PAGE,

[30] FOREIGN APPLICATION PRIORITY DATA:

Insert: --[30] Foreign Application Priority Data
Aug. 4, 1989 [JP] ..... 01-202462--.

COLUMN 2:

Line 26, "ink receiving-layer" should read --ink-receiving layer--

Line 49, "$5.0 \times 10^{-6} \leq K \alpha 3.5 \times 10^{-5}$." should read --$5.0 \times 10^{-6} \leq K \alpha \leq 3.5 \times 10^{-5}$.--.

COLUMN 3:

Line 35, "retension" should read --retention--.

COLUMN 4:

Line 18, "specific a" should read --a specific--.

COLUMN 5:

Line 2, "amount" should read --amount of--.

Line 68, "is (second occurrence) should read --are--.

UNITED STATES PATENT AND TRADEMARK OFFICE

CERTIFICATE OF CORRECTION

PATENT NO. : 5,124,201

DATED : June 23, 1992

INVENTOR(S) : Kurabayashi et al.

It is certified that error appears in the above-identified patent and that said Letters Patent is hereby corrected as shown below:

COLUMN 6:

Line 19, "is" should read --are--.

COLUMN 7:

Line 7, "the" should be deleted;

Line 8, "ejects" should read --eject--;

Line 10, "referring" should read --referring to--; and

Line 15, "Stöchigst" should read --Stöckigt--.

COLUMN 8:

Line 39, "Stöckigst" should read --Stöckigt--.

COLUMN 9:

Line 12, "EXAMPLE 4 to 6" should read --EXAMPLES 4 to 6--;

Line 16, "Example 1 to 3" should read --Examples 1 to 3--;

Line 43, "Stöckigst" should read --Stöckigt--;

Line 46, "was" should read --were--;

UNITED STATES PATENT AND TRADEMARK OFFICE

CERTIFICATE OF CORRECTION

PATENT NO. : 5,124,201 Page 3 of 4

DATED : June 23, 1992

INVENTOR(S) : Kurabayashi et al.

It is certified that error appears in the above-identified patent and that said Letters Patent is hereby corrected as shown below:

COLUMN 9:

Line 48, "lowered." should read --low.--;

Line 65, "Stöckigst" should read --Stöckigt--; and

Line 67, "12 $ml/m^3$" should read --12 $ml/m^2$--.

COLUMN 10:

Table 4, "runningover" should read --running-over--;

Line 30, "Bristow" should read --the Bristow--;

Line 32, "$5.0 \times 10^{-6} \leqq K\alpha \leqq 3.5 \times 10^{5}$." should read --$5.0 \times 10^{-6} \leq K\alpha \leq 3.5 \times 10^{-5}$.--;

Line 57, "ink receiving" should read --ink-receiving--; and

Line 66, "Bristow" should read --the Bristow--.

COLUMN 11:

Line 1, "wherein," should read --wherein--;

Line 2, "water soluble" should read --water-soluble--;

Line 3, "wherein," should read --wherein--;

Line 11, "to" should read --of--;

UNITED STATES PATENT AND TRADEMARK OFFICE

CERTIFICATE OF CORRECTION

PATENT NO. : 5,124,201

DATED : June 23, 1992

INVENTOR(S) : Kurabayashi et al.

It is certified that error appears in the above-identified patent and that said Letters Patent is hereby corrected as shown below:

Line 39, "Bristow" should read --the Bristow--;

Line 43, "wherein," should read --wherein--; and "water soluble" should read --water-soluble--;

Line 46, "wherein," should read --wherein--; and

Line 57, "in number" should be deleted.

COLUMN 12:

Line 26, "Bristow" should read --the Bristow--;

Line 30, "wherein," should read --wherein--; and "water soluble" should read --water-soluble--;

Line 33, "wherein," should read --wherein--; and

Line 43, "in number" should be deleted.

Signed and Sealed this

Twelfth Day of October, 1993

Bruce Lehman

*Attest:*

BRUCE LEHMAN

*Attesting Officer*

*Commissioner of Patents and Trademarks*